US007063040B2

(12) United States Patent
Woods

(10) Patent No.: US 7,063,040 B2
(45) Date of Patent: Jun. 20, 2006

(54) PORTABLE AIR HORN APPARATUS

(75) Inventor: David Terry Woods, 891 Jasmine Avenue, Victoria, British Columbia (CA) V8V 2P3

(73) Assignee: David Terry Woods, Victoria (CA)

( * ) Notice: Subject to any disclaimer, the term of this patent is extended or adjusted under 35 U.S.C. 154(b) by 122 days.

(21) Appl. No.: 10/827,241

(22) Filed: Apr. 20, 2004

(65) Prior Publication Data

US 2005/0231333 A1 Oct. 20, 2005

(51) Int. Cl.
*G10K 7/02* (2006.01)
*G10K 9/22* (2006.01)

(52) U.S. Cl. ..... 116/142 R; 116/137 R; 340/404.1

(58) Field of Classification Search ..... 33/3, 33/77–84, 99, 137 R, 138, 139, 142 FV, 33/142 FP, DIG. 44; 340/404.1, 404.2, 404.3, 340/384.1, 388.1, 391.1, 396.1; 446/405, 446/406, 407; 381/75; D10/120; 116/142 R
See application file for complete search history.

(56) References Cited

U.S. PATENT DOCUMENTS

| | | | | |
|---|---|---|---|---|
| 1,288,636 | A * | 12/1918 | Marsico | 116/144 |
| 1,500,976 | A * | 7/1924 | Wiese et al. | 109/39 |
| 1,760,295 | A * | 5/1930 | Aufiero | 116/142 FP |
| 2,273,130 | A * | 2/1942 | Meyerhoefer | 340/391.1 |
| 2,830,116 | A * | 4/1958 | Hardesty | 381/75 |
| 2,857,876 | A * | 10/1958 | Russell | 116/139 |
| 2,915,587 | A * | 12/1959 | Hardesty | 381/75 |
| 2,918,895 | A | 12/1959 | Buell | 116/142 R |
| 3,588,358 | A * | 6/1971 | Rudmose et al. | 73/585 |
| 3,590,770 | A | 7/1971 | Wagner | 116/112 |
| 3,670,689 | A | 6/1972 | Pappas | 116/112 |
| 3,670,690 | A | 6/1972 | Swanson | 116/112 |
| 3,785,335 | A | 1/1974 | Wagner | 116/112 |
| 3,906,490 | A | 9/1975 | Shaw | 340/391.1 |
| 4,044,712 | A | 8/1977 | Goodman et al. | 116/142 FP |
| 4,050,405 | A | 9/1977 | Palm | 116/142 FP |
| 4,166,428 | A | 9/1979 | Freeman et al. | 116/86 |
| 4,314,522 | A | 2/1982 | Frigo | 116/142 R |
| 4,821,026 | A * | 4/1989 | Newsom | 340/574 |

(Continued)

FOREIGN PATENT DOCUMENTS

DE 2552744 A * 6/1976

(Continued)

OTHER PUBLICATIONS

Korean Patent Abstract; Korean Intellectual Property Office; 84001409 B1; "Electron Gun for Sport"; Sep. 24, 1984; G04F 13/00; Hwang, Chil Sung et al.

*Primary Examiner*—R. Alexander Smith

(57) ABSTRACT

A portable air horn apparatus. The apparatus includes an air horn adapted to generate sound when supplied with air under pressure, an air compressor adapted to generate air under pressure, an air conduit interconnecting the compressor and the air horn enabling the air under pressure generated by the compressor to be supplied to the air horn, an electric motor adapted to operate the air compressor when energized, a portable source of electrical energy, and electrical circuitry electrically connecting the portable source of electrical energy to the electric motor to enable the electric motor to be energized. The circuitry includes a manually operable on-off switch having a first position opening the circuitry and a second position closing the circuitry. A housing is provided for physically supporting and interconnecting at least the air horn, compressor, electric motor, on-off switch and portable source of electrical energy, and includes a handle adapted to be manually graspable by a user of the device.

12 Claims, 3 Drawing Sheets

U.S. PATENT DOCUMENTS

| | | | | |
|---|---|---|---|---|
| 4,829,930 | A | 5/1989 | Fischer et al. | 116/142 FP |
| 5,032,824 | A * | 7/1991 | Corbin | 340/574 |
| 5,259,807 | A * | 11/1993 | Crow | 446/397 |
| 5,355,830 | A | 10/1994 | deJong | 116/142 FP |
| 5,465,196 | A * | 11/1995 | Hasenberg et al. | 362/183 |
| 5,748,089 | A * | 5/1998 | Sizemore | 340/574 |
| 6,119,671 | A | 9/2000 | Smith et al. | 124/59 |
| 6,294,984 | B1 | 9/2001 | Meister | 340/404.1 |
| D488,736 | S * | 4/2004 | Wiggerman | D10/120 |
| 2005/0231333 | A1* | 10/2005 | Woods | 340/388.1 |

FOREIGN PATENT DOCUMENTS

| | | | |
|---|---|---|---|
| DE | 3803388 | A * | 8/1989 |
| JP | 3221793 | | 9/1991 |
| JP | 6207797 | | 7/1994 |
| JP | 6235597 | | 8/1994 |
| JP | 09055102 | A * | 2/1997 |
| KR | 8401409 | | 9/1984 |
| SE | 466978 | | 5/1992 |

* cited by examiner

PORTABLE AIR HORN APPARATUS

BACKGROUND OF THE INVENTION

I. Field of the Invention

This invention relates to air horns used to provide warning sounds over wide distances. More particular, the invention relates to air horn apparatus that is portable.

II. Background Art

Air horns are commonly used as warning devices because they are capapble of providing very loud and distinctive sounds that carry over large distances. For example, air horns are used in the mining and construction industry to provide warnings when blasting is about to take place.

A very common kind of portable air horn apparatus consists of an air horn attached to a valve device that can be fitted to the neck of a compressed gas canister. The valve device includes a trigger that, when operated, allows compressed gas from the canister to operate the air horn. Devices of this kind are relatively inexpensive and lightweight and can generate sound at a high volume. However, gas canisters contain a finite amount of compressed gas that allows only a few uses before the canister has to be changed. Even worse, the valve devices tend to allow leakage of the gas from the canisters, thus further reducing the number of uses of the device before replacement of the canister is necessary. Gas leakage can also lead costly or dangerous situations in which an apparatus is unexpectedly found to be inoperative due to leakage and necessary warnings cannot be given, at least until a new canister can be obtained. The unreliability of apparatus of this kind makes it unsuitable for professional use.

There is consequently a need for more reliable and effective apparatus of this kind.

SUMMARY OF THE INVENTION

An object of the invention is to provide a portable air horn apparatus that is dependable even if only used intermittently.

According to one aspect of the invention, there is provided a portable air horn apparatus, comprising: an air horn adapted to generate sound when supplied with air under pressure; an air compressor adapted to generate air under pressure; an air conduit interconnecting the compressor and the air horn enabling the air under pressure generated by the compressor to be supplied to the air horn; an electric motor adapted to operate the air compressor when energized; a portable source of electrical energy; electrical circuitry electrically connecting the portable source of electrical energy to the electric motor to enable the electric motor to be energized, the circuitry including a manually operable on-off switch having a first position opening the circuitry and a second position closing the circuitry; and a housing for physically supporting and interconnecting at least the air horn, compressor, electric motor, on-off switch and portable source of electrical energy, and including a handle adapted to be manually graspable by a user of the device.

The invention also relates to such an apparatus without said portable source of energy, but adapted to interconnect with such a source (e.g. a battery) provided by the user.

The apparatus of the present invention requires no reservoir for compressed air and is operated by air generated "on demand" under a fixed and constant pressure. Thus, unlike reservoir devices, there is no change of pressure with time as the reservoir of gas is used up. The sound and sound volume thus do not change with time.

By using a suitable portable power source, the device can be kept operational for a prolonged period of time and can be restored to operational status merely by recharging or replacing the portable power source. The apparatus can be made relatively light in weight and convenient to use.

BRIEF INTRODUCTION OF THE DRAWINGS

DETAILED DESCRIPTION OF THE INVENTION

Figure 1:
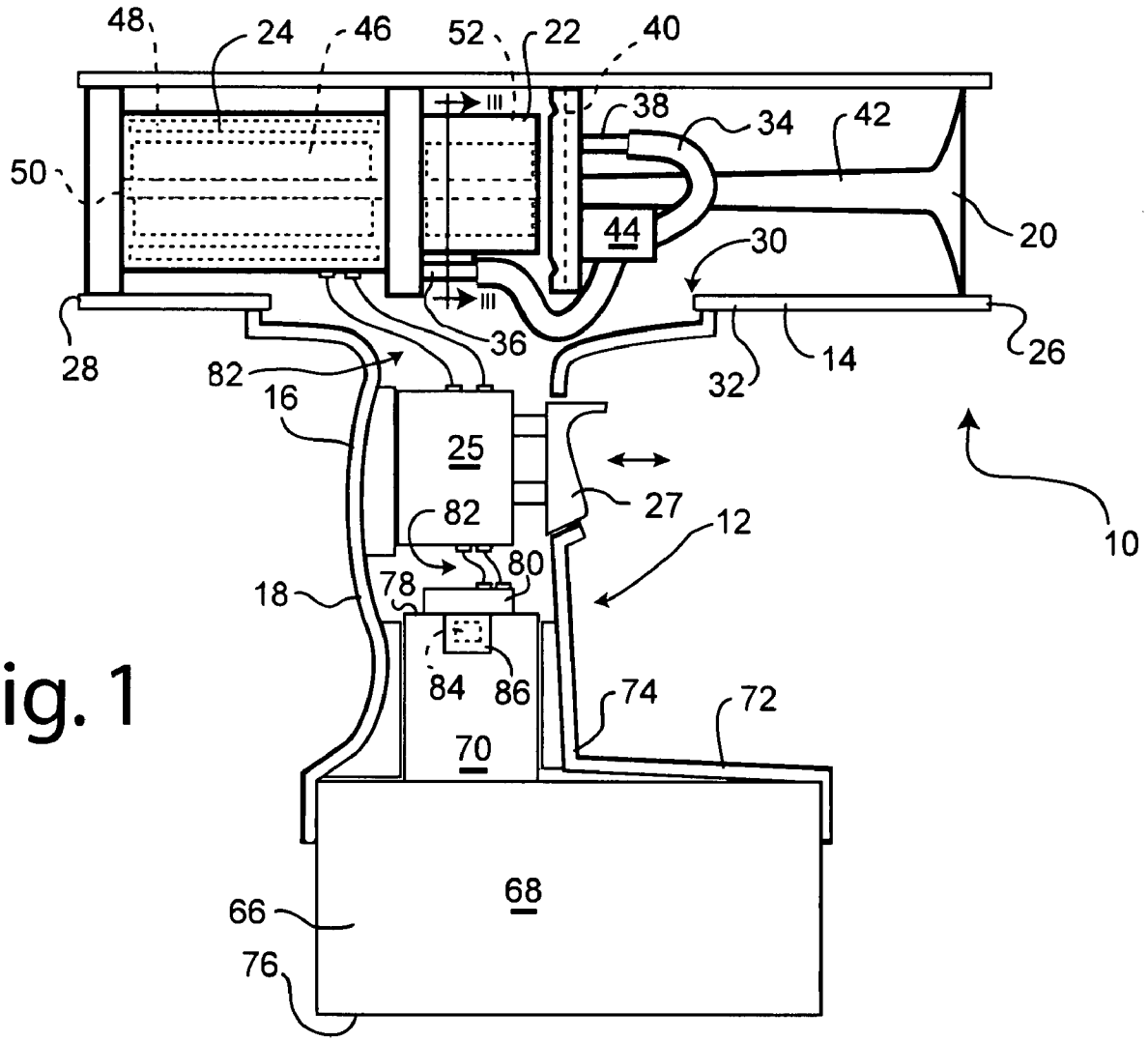
FIG. 1 is a cross section of one preferred form of an apparatus according to the present invention.

The device shown in FIG. 1 of the accompanying drawings is one embodiment of a portable air horn apparatus 10 according to the present invention. The apparatus 10 has a housing 12 consisting of two main parts. A first part is in the form of an elongated tubular element 14, and a second part is in the form of an elongated member 16 attached to the tubular element 14 at one end of the elongated member and extending from the tubular element 14 at an angle, preferably in the range of about 75 to 105 degrees, and optionally around 90 degrees. The apparatus consequently resembles a pistol with the tubular element 14 forming the "barrel" and the elongated member 16 forming a handle 18 in the form of a "pistol grip" that can be grasped by a user in one hand to carry and operate the apparatus. The housing 12 serves the purpose of physically supporting and interconnecting the parts of the apparatus so that they form a unitary whole. The housing 12 also encloses and protects most of the parts and provides an attractive and functional appearance to the apparatus.

Figure 2:
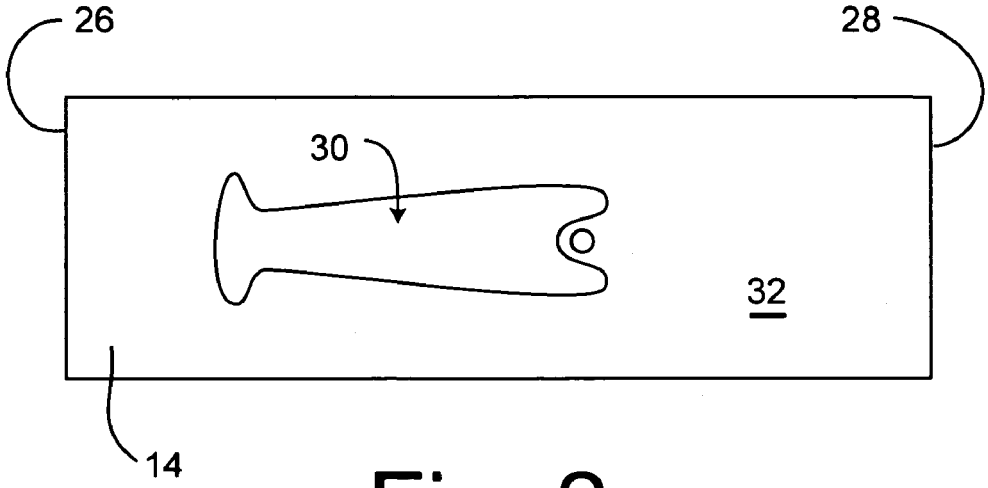
FIG. 2 is an underside view of a tubular element used in the embodiment of FIG. 1 showing an elongated slot.

The tubular element 14, which is preferably made of metal but may be made of plastics or any other suitable material, encloses an air horn 20 (which may be of a conventional design), an air compressor 22 that generates a stream of air under pressure and an electric motor 24 for operating the air compressor 22. The tubular element 14 is open at opposite ends 26 and 28, and has a slot-like opening 30 positioned centrally between the opposite ends in the lower part of outer wall 32 of the tubular element. The slot-like opening 30, which is shown more clearly in FIG. 2, allows the components of the apparatus to be interconnected without any connecting parts being visible from the exterior of the apparatus. The shape of the slot conforms to the shape of the handle 18 at the point where the handle joints the tubular element 14 so that no parts of the slot are visible from the outside.

The motor 24, air compressor 22 and air horn 20 may be held in place within the tubular element 14 simply by a friction fit if parts of these components are dimensioned to fit snugly within the tubular element (as shown). However, these components may be fixed more permanently by means of screws (not shown) or the like extending through the outer wall 32 of the tubular element into holes drilled into the components.

A flexible hose 34 forms an air conduit for supplying a stream of compressed air from the compressor 22 to the air horn 20. One end of the hose is fitted over a nipple 36 projecting from the compressor and the other is fitted over a nipple 38 that communicates with to the interior of the air horn 20, which contains a vibratable diaphragm 40 that generates a sound that is then amplified by an elongated trumpet element 42. A central region of the hose 34 is secured within a clip 44 attached to the air horn 20 to reduce the likelihood that the hose will become detached at one or both ends during use or transportation.

Figure 3:
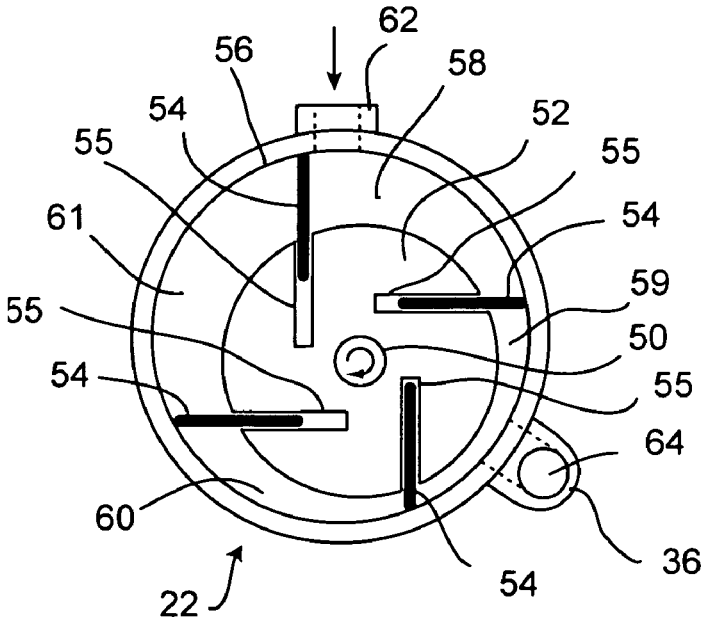
FIG. 3 is a cross-section taken on the line III—III of FIG. 1.

The electric motor 24 is a DC motor having, for example, a conventional armature 46 and magnets 48 illustrated in broken lines. A central shaft 50 extends from the motor into the air compressor 22 to rotate a compressor rotor 52 to pressurize air drawn into the compressor from the exterior. The interior of the compressor 22 is shown in more detail in the cross-sectional view of FIG. 3 and it will be seen that the rotor 52 is provided with four vanes 54 that are slidably held within slots 55 in the rotor. The vanes may move between a retracted position, in which most of the vane is held in the slot, to an extended position, in which most of the vane projects from its associated slot. The rotor 52 is mounted off-center within a chamber 56 within the compressor and the vanes divide the free space within the chamber into four segments 58, 59, 60 and 61. As the rotor rotates, air trapped in segment 58 (which enters the chamber via port 62), is moved around the chamber into a smaller volume formerly occupied by segment 59, the smaller volume being due to the off-centre location of the rotor in the chamber. Consequently, the air is compressed and leaves the chamber 56 through a gas delivery port 64 formed within nipple 36 (see FIG. 1). As the rotor continues to rotate, the free volume increases in segments 60 and 61, so the gas in these segments is reduced in pressure and draws more air into the chamber when connected to the port 62.

Referring again to FIG. 1, the second part of the housing in the form of an elongated member 16 is preferably made of a molded plastics material (e.g. injection molded plastics) that is shaped to fit the contours of the hand and is attached to the tubular element 14 by means of screws (not shown) or by an adhesive. The elongated member may itself consist of two parts separated from each other along a vertical plane running centrally of the apparatus from front to rear. The two parts may be joined together by screws or adhesive (not shown). This elongated member 18 contains a manually operable on-off switch 25 held firmly within the handle 18, circuitry 82 and at least part of a portable energy source 66. The manually operable on-off switch 25 is preferably operated by a trigger 27 that can be squeezed by a user's index finger when gripping the handle. The trigger 27 is biased outwardly to the "off" position, and remains in that position until squeezed to the "on" position. Releasing the trigger causes'it to return under the spring bias to the "off" position. Thus, again, the apparatus resembles a pistol in its appearance and operation.

The electric motor 24 is energized by the portable energy source 66 via the circuit 82 when the manually operable trigger 27 is in the "on" position. In turn, the motor drives the compressor and the resulting compressed air is directed to the air horn which creates a piercing sound. Consequently, in use, the user simply squeezes the trigger 25 for as long as the sound is to be made. Releasing the trigger then ends the generation of the sound.

The portable energy source 66 for the apparatus is provided at the lower end of the handle 18. The portable energy source is preferably a rechargeable battery of the kind used to power portable tools, such as electric drills or electric screw drivers. However, other portable energy sources may be employed, e.g. non-rechargeable batteries or fuel cells. It is of course important to use an energy source that is not too bulky or heavy, otherwise the apparatus will not be portable (e.g. transportable by hand by a single user without the need for a vehicle or movable support). Normally, the bulkier and heavier the power source, the longer the apparatus remains powered and ready for use. However, it is generally desirable to make the weight of the power source 2.5 Kg or less (more preferably 1 Kg or less) in order to make the apparatus readily portable.

In the illustrated embodiment, the portable energy source has an enlarged body 68 provided with an upstanding elongated projection 70. The projection 70 extends fully into a hollow space within the handle 18 from below and the enlarged body 68 remains mostly outside the handle except for the top edge that is covered by an enlarged cowling 72 forming a lower end 74 of the handle 18. The cowling 72 removably attaches to the body 68 via releasable catches (not shown) formed on opposite sides of the cowling 72 and engaging opposite sides of the energy source 66. The portable energy source can therefore be removed from the housing 12 when desired and replaced or returned as needed. The enlarged body 68 has a flat lower surface 76 so that the portable energy source may act as a stand for the apparatus when placed on a flat support. Additionally, when the portable energy source is a rechargeable battery, the lower surface may also be provided with contacts (not shown) for electrical connection to a charging device or docking station of a known kind. Alternatively, the portable energy source or the housing 12 may have a socket for connection to a source of current for recharging the portable power source from a suitable charger.

The upper end 78 of the upstanding projection 70 engages with an electrical connector 80 forming part of circuitry 82 for the apparatus. Electrical contacts 84 on the upper end of the upstanding projection engage with contacts 86 in the connector so that the circuit 82 may be energized by the portable power source.

Figure 4:
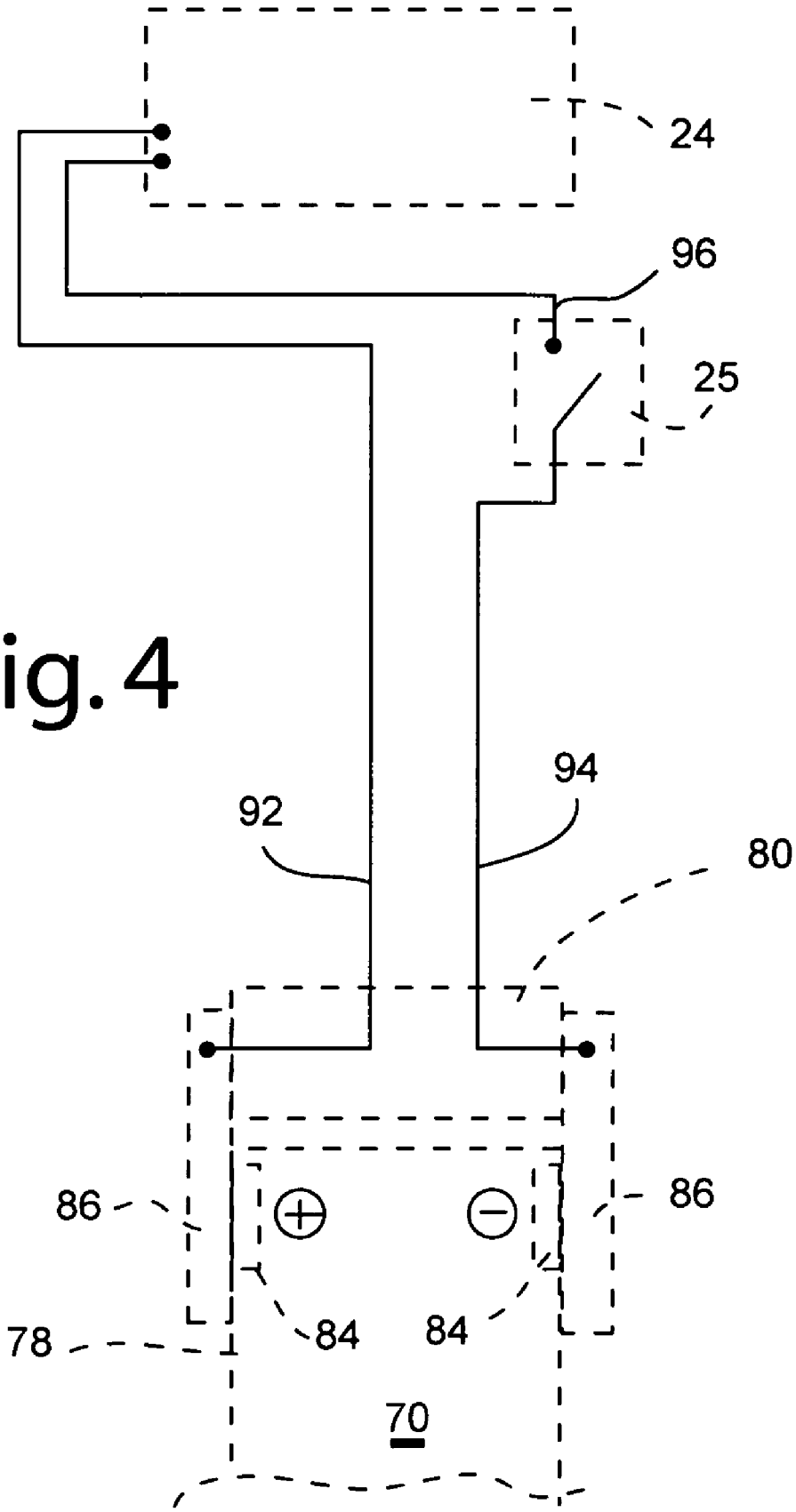
FIG. 4 is a circuit diagram of the circuitry employed in the embodiment of FIG. 1.

The electrical circuit 82 is shown in more detail in FIG. 4 of the accompanying drawings in which physical components are shown in dotted lines and circuit elements are shown in unbroken lines. The upper end 78 of the upstanding projection 70 of the portable energy source 66 is retained within electrical connector 80 having metal contacts 86 that connect to the contacts 84 of the portable energy source. A wire 92 is connected to one of the contacts 86 directly to the motor 24. A second wire 94 leads to the manually operable on-off trigger switch 25. A third wire 96 then extends from switch 25 to the motor 24. As will be appreciated, when switch 25 is closed, the motor will be energized and the air horn will sound.

The invention claimed is:

1. A portable air horn apparatus, comprising:

an air horn adapted to generate a warning sound when supplied with a contained stream of pressurized air, said air horn being provided with a vibratable diaphragm, an elongated trumpet element, and an inlet nozzle for receiving therethrough the contained stream of pressurized air;

an air compressor unit configured to generate pressurized air, said air compressor unit being provided with an outlet nozzle for releasing a stream of pressurized air therethrough;

a pressurized air conduit interconnecting said outlet nozzle of the air compressor unit and said inlet nozzle of the air horn, said air conduit adapted for supplying a stream of pressurized air therethrough;

an electric motor adapted to operate said air compressor unit when said electric motor is energized;

a portable source of electrical energy;

electrical circuitry electrically connecting said portable source of electrical energy to said electric motor to enable said motor to be energized, said circuitry including a manually operable on-off switch having a first position opening said circuitry and a second position closing said circuitry; and a housing for physically supporting and containing therein at least said air horn, said air compressor unit, said pressurized air conduit, said electric motor, said on-off switch and said portable source of electrical energy, said housing including a handle adapted to be manually grasped by a user of the device.

2. Apparatus according to claim 1, wherein said on-off switch is positioned on said handle at a position in which said switch is operable by a finger of said user when grasping said handle.

3. Apparatus according to claim 1, wherein said on-off switch has a trigger that is biased by a spring to an "off" position, but may be moved to and held in an "on" position by squeezing the trigger against the force of said spring.

4. Apparatus according to claim 1, wherein said housing includes an elongated tubular element retaining said air horn, said air compressor unit, and said pressurized air conduit.

5. Apparatus according to claim 4, wherein said handle is an elongated member attached to said elongated tubular element at one end of said handle and extending at an angle from said tubular element to form a pistol grip.

6. Apparatus according to claim 1, wherein said portable source of electrical energy is a battery.

7. Apparatus according to claim 6, wherein said battery is a rechargeable battery.

8. Apparatus according to claim 6, wherein said battery includes an enlarged body and an elongated projection extending from a surface of said body, said elongated projection being adapted to extend into said handle and to be retained therein while said enlarged body remains at least partially outside said handle.

9. Apparatus according to claim 8, wherein said enlarged body has a generally flat lower surface that enables said battery to act as a stand for the apparatus when positioned with said lower surface on a flat support.

10. Apparatus according to claim 9, wherein said projection of said battery is releasably retained in said handle, thus enabling said battery to be detached from said housing and reattached or replaced when desired.

11. Apparatus according to claim 1, wherein said portable source of energy weighs 2.5 Kg or less.

12. A portable air horn apparatus for connection to a portable energy source, comprising:

an air horn adapted to generate a warning sound when supplied with a contained stream of pressurized air, said air horn being provided with a vibratable diaphragm, an elongated trumpet element, and an inlet nozzle for receiving therethrough the contained stream of pressurized air;

an air compressor unit configured to generate pressurized air, said air compressor unit being provided with an outlet nozzle for releasing a stream of pressurized air therethrough;

a pressurized air conduit interconnecting said outlet nozzle of the air compressor unit and said inlet nozzle of the air horn, said air pressurized air conduit being adapted for supplying a stream of pressurized air therethrough;

an electric motor adapted to operate said air compressor unit when said electric motor is energized;

electrical circuitry having connectors adapted for electrically connecting a portable source of electrical energy to said electric motor to enable said electric motor to be energized, said circuitry including a manually operable on-off switch having a first position opening said circuitry and a second position closing said circuitry; and a housing for physically supporting and containing therein at least said air horn, said air compressor unit, said pressurized air conduit, said electric motor, and said on-off switch, said housing including a handle adapted to be manually grasped by a user of the device and means for supporting at least part of a portable energy source for said apparatus.

* * * * *